US008596261B2

(12) United States Patent
Maxson et al.

(10) Patent No.: US 8,596,261 B2
(45) Date of Patent: Dec. 3, 2013

(54) PASSIVE SOLAR WIRE SCREENS FOR BUILDINGS

(75) Inventors: Richard C. Maxson, Maple Grove, MN (US); Michael Ekholm, Minneapolis, MN (US)

(73) Assignee: Bilfinger Water Technologies, Inc., New Brighton, MN (US)

( * ) Notice: Subject to any disclaimer, the term of this patent is extended or adjusted under 35 U.S.C. 154(b) by 0 days.

(21) Appl. No.: 13/249,034

(22) Filed: Sep. 29, 2011

(65) Prior Publication Data

US 2012/0067340 A1 Mar. 22, 2012

Related U.S. Application Data

(63) Continuation of application No. 12/258,796, filed on Oct. 27, 2008, now Pat. No. 8,028,691.

(51) Int. Cl.
*F24J 2/00* (2006.01)

(52) U.S. Cl.
USPC ..... 126/702; 126/701; 49/50; 49/57; 52/73; 52/74; 52/75; 52/78; 52/473

(58) Field of Classification Search
USPC ..... 126/701, 702; 52/73, 74, 75, 78, 473
See application file for complete search history.

(56) References Cited

U.S. PATENT DOCUMENTS 2,046,458 A 11/1934 Johnson
2,146,816 A * 2/1939 Grassby, Jr. ..... 160/178.1 R
2,209,355 A * 7/1940 Schmitz ..... 160/178.1 R
2,309,717 A * 1/1943 Siebenlist ..... 454/283
2,389,970 A * 11/1945 Ferguson ..... 160/62
2,546,335 A * 3/1951 Friend ..... 359/596
2,749,581 A * 6/1956 McCormick ..... 49/90.1
2,906,506 A * 9/1959 Barnes et al. ..... 256/19

(Continued)

FOREIGN PATENT DOCUMENTS

AU 600371 B2 * 1/1989
DE 4001792 A1 7/1991

(Continued)

OTHER PUBLICATIONS

Examiner's First Report in counterpart Australian Appl. No. 2009203179, dated Sep. 24, 2010.

(Continued)

*Primary Examiner* — Kenneth Rinehart
*Assistant Examiner* — Jorge Pereiro
(74) *Attorney, Agent, or Firm* — Moore & Van Allen PLLC

(57) ABSTRACT

Passive solar wire screens mount vertically on an edifice. The screens have rods vertically arranged parallel to one another and have wires horizontally arranged parallel to one another. The wires attach to the rods and have first surfaces facing away from the edifice in an upward direction from vertical. The wires also have second surfaces facing toward the edifice in a downward direction from vertical. When the sun has a summer elevation on the horizon, the first surfaces passively reflect solar energy incident thereto away from the wire screens. When the sun has a winter elevation on the horizon, however, the first surfaces passively reflect solar energy incident thereto toward the second surfaces, which in turn passively reflect the solar energy toward the edifice. A concave surface on the wires can also reflect thermal energy back to the edifice.

30 Claims, 4 Drawing Sheets

(56) References Cited

U.S. PATENT DOCUMENTS

| | | | | | |
|---|---|---|---|---|---|
| 3,014,252 | A | * | 12/1961 | Osborne | 52/786.11 |
| 3,072,230 | A | * | 1/1963 | Gelert | 52/473 |
| 3,077,643 | A | * | 2/1963 | Horner | 52/473 |
| 3,113,356 | A | * | 12/1963 | Piper | 52/473 |
| 3,238,683 | A | * | 3/1966 | Maxwell | 52/473 |
| 3,276,942 | A | * | 10/1966 | Ewing | 428/105 |
| 3,437,538 | A | * | 4/1969 | Ewing | 156/167 |
| 3,438,167 | A | * | 4/1969 | Royston, Jr. | 52/473 |
| 3,941,703 | A | | 3/1976 | Binard | |
| 3,971,359 | A | | 7/1976 | Bourne | |
| 4,089,594 | A | | 5/1978 | Ewin | |
| 4,096,911 | A | | 6/1978 | Geske | |
| 4,145,855 | A | | 3/1979 | Sheldon | |
| 4,217,742 | A | | 8/1980 | Evans | |
| 4,232,731 | A | | 11/1980 | Kaplow et al. | |
| 4,264,438 | A | | 4/1981 | Frejborg | |
| 4,265,222 | A | | 5/1981 | Kapany et al. | |
| 4,276,265 | A | | 6/1981 | Gillespie | |
| 4,337,754 | A | | 7/1982 | Conger | |
| 4,409,960 | A | | 10/1983 | Balzer | |
| 4,459,975 | A | | 7/1984 | Hobart | |
| 4,498,455 | A | | 2/1985 | Gramm | |
| 4,541,214 | A | * | 9/1985 | Lambert | 52/473 |
| 4,715,358 | A | | 12/1987 | Koster | |
| 4,819,722 | A | | 4/1989 | Daly | |
| 4,828,689 | A | | 5/1989 | Lamort | |
| 4,846,971 | A | | 7/1989 | Lamort | |
| 5,015,383 | A | | 5/1991 | Evans et al. | |
| 5,047,148 | A | | 9/1991 | Arai | |
| 5,090,721 | A | | 2/1992 | Lange | |
| 5,094,360 | A | | 3/1992 | Lange | |
| 5,118,419 | A | | 6/1992 | Evans et al. | |
| 5,156,738 | A | | 10/1992 | Maxson | |
| 5,237,154 | A | | 8/1993 | Pellhammer et al. | |
| 5,255,790 | A | | 10/1993 | Einoder et al. | |
| 5,295,051 | A | | 3/1994 | Cowling | |
| 5,353,565 | A | | 10/1994 | Tanikawa | |
| 5,387,340 | A | | 2/1995 | Ackerman | |
| 5,411,312 | A | | 5/1995 | Stallings | |
| 5,511,537 | A | | 4/1996 | Hively | |
| 5,672,101 | A | | 9/1997 | Thomas | |
| 5,718,826 | A | | 2/1998 | Frejborg | |
| 5,755,034 | A | | 5/1998 | Yasue et al. | |
| 5,768,783 | A | | 6/1998 | Lange | |
| 5,788,860 | A | | 8/1998 | Yasue et al. | |
| 5,791,495 | A | | 8/1998 | Gero et al. | |
| 5,954,956 | A | | 9/1999 | Lutz et al. | |
| 6,047,834 | A | | 4/2000 | Dolle et al. | |
| 6,056,126 | A | | 5/2000 | Schabel et al. | |
| 6,092,286 | A | | 7/2000 | Lange | |
| 6,119,867 | A | | 9/2000 | Ljokkoi et al. | |
| 6,158,175 | A | | 12/2000 | Carter | |
| 6,239,910 | B1 | | 5/2001 | Digert | |
| 6,240,999 | B1 | | 6/2001 | Koster | |
| 6,311,437 | B1 | | 11/2001 | Lorenz | |
| 6,340,805 | B1 | | 1/2002 | Ljokkoi | |
| 6,367,937 | B2 | | 4/2002 | Koster | |
| 6,425,486 | B1 | | 7/2002 | Amdersson et al. | |
| 6,426,003 | B2 | | 7/2002 | May et al. | |
| 6,430,954 | B1 | | 8/2002 | Smith | |
| 6,460,757 | B1 | | 10/2002 | Ommundsen | |
| 6,491,168 | B1 | | 12/2002 | Lutz et al. | |
| 6,581,589 | B1 | | 6/2003 | Fent et al. | |
| 6,595,017 | B1 | | 7/2003 | Teahan | |
| RE38,303 | E | | 11/2003 | Askew | |
| 6,708,829 | B2 | | 3/2004 | Robertson et al. | |
| 6,714,352 | B2 | | 3/2004 | Rogers et al. | |
| 6,785,964 | B2 | | 9/2004 | Raphaël | |
| 6,851,560 | B2 | | 2/2005 | Reig et al. | |
| 7,168,570 | B2 | | 1/2007 | Frejborg | |
| 8,054,546 | B2 | * | 11/2011 | Koster | 359/443 |
| 2002/0174671 | A1 | | 11/2002 | Wilkinson | |
| 2004/0238413 | A1 | | 12/2004 | Ekholm | |
| 2008/0202703 | A1 | | 8/2008 | Edmonds | |
| 2009/0120594 | A1 | * | 5/2009 | Koster | 160/220 |
| 2009/0183764 | A1 | | 7/2009 | Meyer | |
| 2009/0255568 | A1 | | 10/2009 | Morgan | |
| 2009/0320388 | A1 | | 12/2009 | Lilli et al. | |

FOREIGN PATENT DOCUMENTS

| | | | |
|---|---|---|---|
| EP | 1980705 | A1 | 10/2008 |
| JP | 10025869 | A | 1/1998 |
| WO | 97/20104 | A1 | 6/1997 |
| WO | 99/22064 | A1 | 5/1999 |

OTHER PUBLICATIONS

First Office Action in counterpart Canadian Appl. No. 2,675,262, dated Jun. 21, 2011.

Second Office Action in counterpart Canadian Appl. 2,675,232, dated Apr. 5, 2012.

Product Information Brochure; "Internals for Radial Flow Reactors;" Johnson Screens; (c) 2006; 12 pages.

Product Information Brochure; "Internals for Down Flow Reactors;" Johnson Screens; (c) 2006; 12 pages.

Product Information Brochure; "Innovative Solutions in Screen Technology;" Johnson Screens; (c) 2006 Weatherford; 12 pages.

European Patent Office, Application No. 09013342.2, Extended European Search Report dated Sep. 25, 2012.

Australian Patent Office, Application No. 2009203179, Examiner's Report dated Sep. 24, 2010.

Canandian Patent Office, Application No. 2,675,232, Office Action dated Jan. 21, 2013.

* cited by examiner

PASSIVE SOLAR WIRE SCREENS FOR BUILDINGS

CROSS-REFERENCE TO RELATED APPLICATIONS

This is a continuation of U.S. patent application Ser. No. 12/258,796, filed 27 Oct. 2008, which is incorporated herein by reference in its entirety and to which priority is claimed.

BACKGROUND

Wire screens are used for chemical filtration, architectural accents, and other purposes. FIG. 1 shows the typical construction of a prior art wire screen. As shown, the screen has parallel wires 12 attached by welds 16 to parallel rods 14 oriented perpendicularly thereto. The wires 12 can be V-shaped wires, and the rods 14 can be cylindrical, square, etc. Both the wires 12 and rods 14 are typically made of stainless steel, but they can be made of other materials, including aluminum and copper alloys.

In industrial applications, gaps between the screen's wires 12 can filter chemical compositions, solids, etc. In architectural applications, the screens can be used on a building as a decorative feature for frontages, overhangs, column covers, floor gratings, ventilation grids, wall partitions, handrails, etc. For example, the Seven World Trade Center in New York and the Guthrie Theater parking garage in Minneapolis have wire screens that cover the exterior. Typically, the architectural design of such wire screens has focused on the reflectivity and orientation of the wire surfaces to enhance appearance.

SUMMARY

Passive solar wire screens mount vertically on an edifice, building, or other structure. The screens have rods vertically arranged parallel to one another and have wires horizontally arranged parallel to one another and attached to the rods. The wires have first surfaces facing away from the edifice in an upward direction and have second surfaces facing toward the edifice in a downward direction. When the sun has a higher summer elevation on the horizon, the first surfaces passively reflect solar energy incident thereto away from the screens, thereby reflecting the solar energy away from the edifice. When the sun has a lower winter elevation on the horizon, however, the first surfaces passively reflect solar energy incident thereto toward the second surfaces, which in turn passively reflect the solar energy toward the edifice. A concave surface on the inner edges of the wires can also reflect thermal energy back to the edifice.

DETAILED DESCRIPTION

Figure 1:
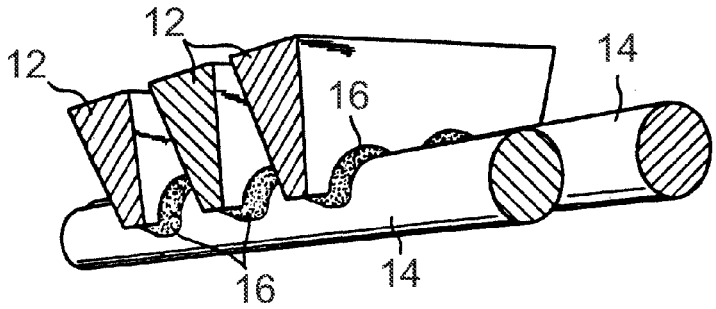
FIG. 1 (Prior Art)
FIG. 1 illustrates the typical construction of a prior art wire screen.
Figure 2:
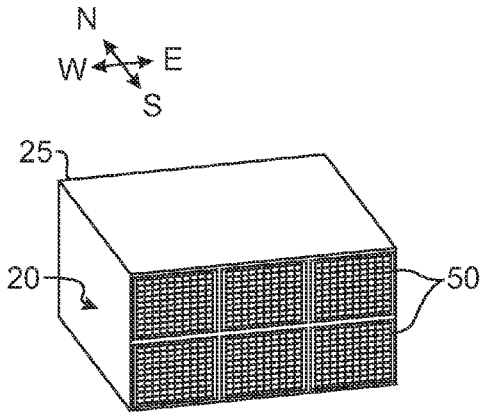
FIG. 2 illustrates an implementation of a wire screen system according to certain teachings of the present disclosure.
Figure 2:
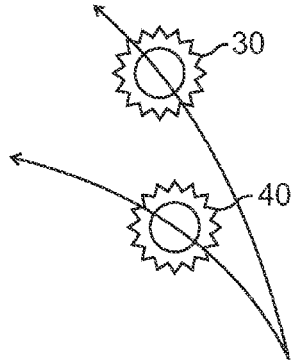

A passive wire screen system 20 schematically illustrated in FIG. 2 has a plurality of wire screens 50 mounted on a building or other edifice 25. Although the wire screens 50 can be used for buildings, they could also be used for non-building applications, such as delivery trucks, rail cars, temporary structures, etc. These wire screens 50 can be constructed as panels and made of any particular dimensions suitable for their own support and reinforcement, and the screens 50 can attach to the building 25 using any conventional technique, such as brackets, frames, and other similar mounting hardware. The wire screens 50 can be designed with standard dimensions and mounting hardware or may be individually configured for a given implementation.

In the northern hemisphere, the wire screens 50 are preferably mounted on one or more south-facing walls of the building 25 (the opposite being the case of a building in the southern hemisphere) so that the wire screens 50 face the orientation of the sun as it travels across the sky. As oriented, the wire screens 50 can reflect solar energy away from the building 25 when the sun has a higher summer elevation 30 on the horizon and can direct solar energy toward the building 25 when the sun has a lower winter elevation 40. In this way, the wire screens 50 act as a seasonally reflective exterior surface of the building 25 that passively reflects solar energy in the summer and passively collects solar energy in the winter to reduce both heating and cooling costs for the building 25.

Figure 3A:
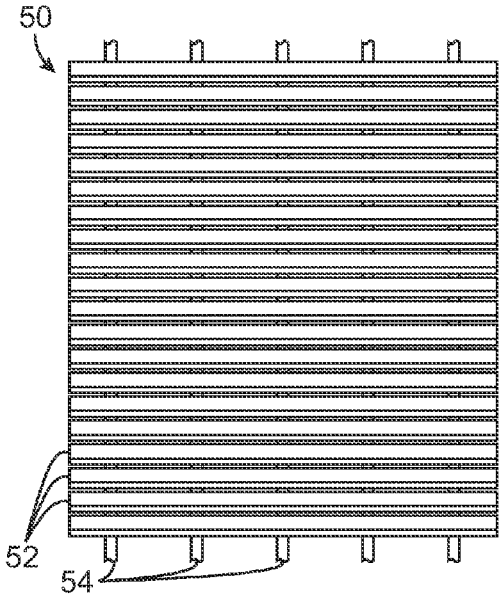
FIGS. 3A-3B illustrate front and back views of portion of a wire screen.
Figure 3B:
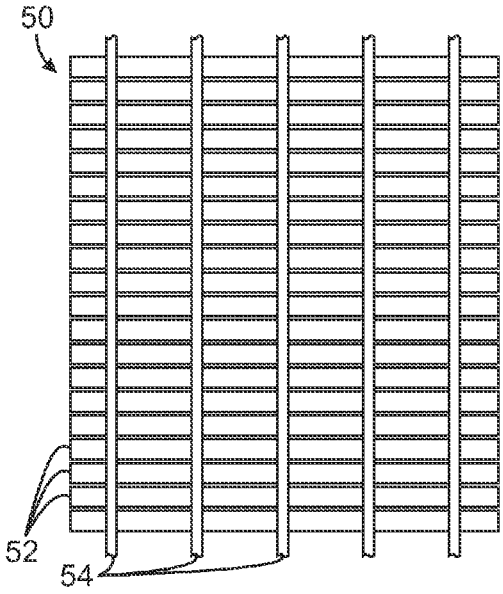

Front and back sides of portion of a wire screen 50 are shown in FIGS. 3A-3B, respectively. The screen 50 has a plurality of horizontally arranged wires 52 positioned parallel to one another on its front face as shown in FIG. 3A. These wires 52 weld to a plurality of vertically arranged rods 54 positioned on the screen's back face as shown in FIG. 3B. Many of the same techniques for constructing, arranging, and welding wire screens known in the art can also be used for the wires 52 and rods 54 of the disclosed screens 50 so that specific details are not provided herein. The wires 54, however, have an asymmetrical shape to achieve the reflection and collection of solar energy so that fabricating the screen 50 may require particular attention to precision when attaching the wires 54 to the rods 52.

The wire screens 50 mounted to the building 25 are entirely passive and function without moving parts, such as an adjustable louver system, electronic controls, and the like. In this way, the wire screens 50 can operate passively with the seasonal changes in reflectivity while still functioning as a decorative feature. Lacking a movable louver and control system or the like, the passive wire screens 50 require less cost for installation and operation, although the disclosed screens 50 could be constructed with such moving parts if desired.

Figure 4A:
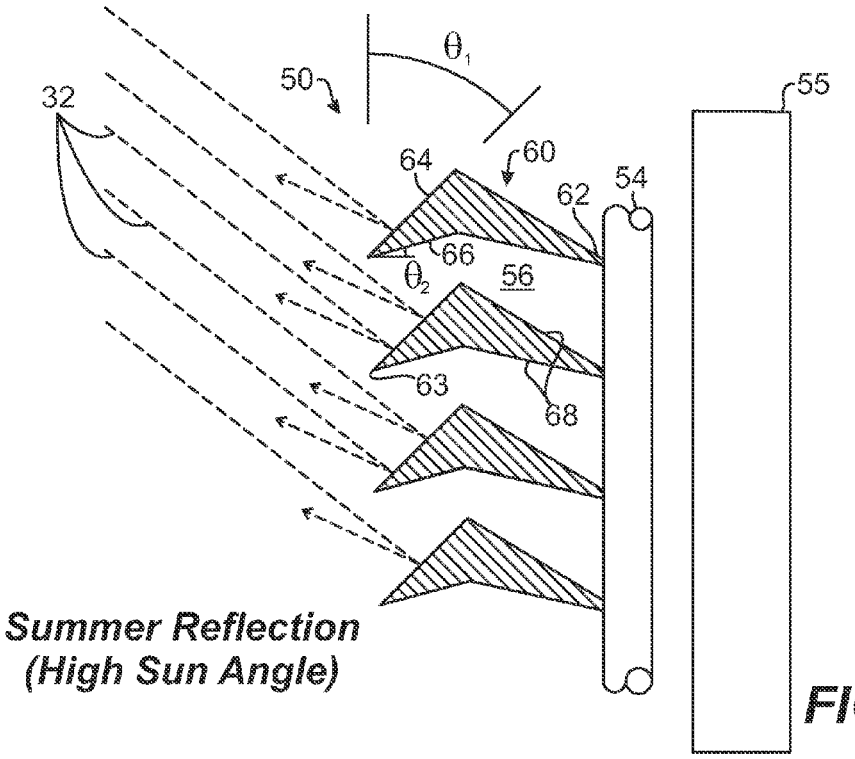
FIG. 4A shows an end view of portion of a wire screen having one type of wire during a summer reflection period.
Figure 4B:
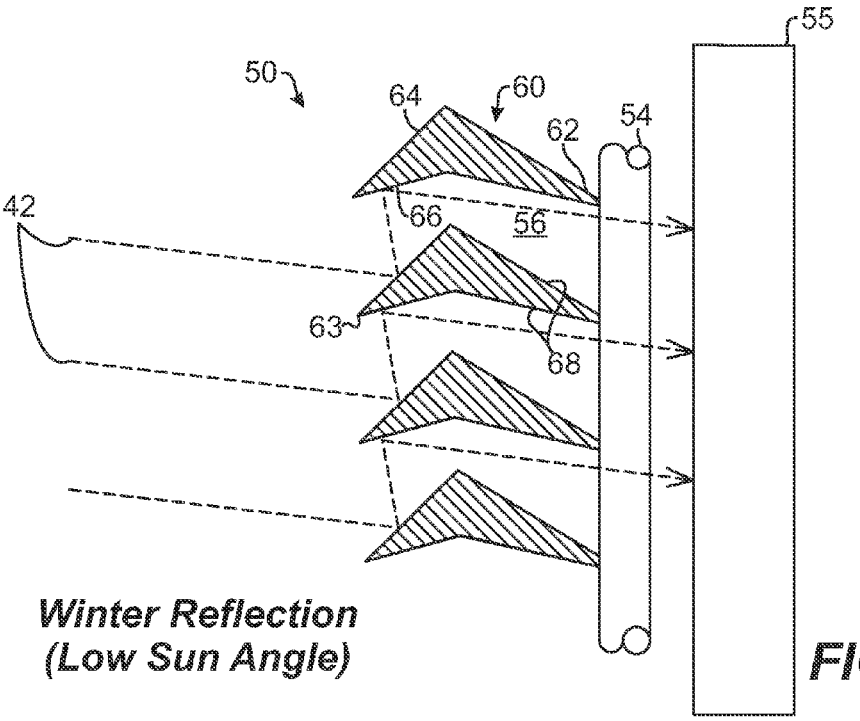
FIG. 4B shows an end view of the wire screen of FIG. 4A during a winter reflection period.

As noted briefly above, the wires 52 of the screen 50 have an asymmetrical shape that is different than the conventional wires used on prior art wire screens. In particular, FIGS. 4A-4B show details of one embodiment of wires 60 for the disclosed wire screen 50. In the end view shown, the screen 50 mounts adjacent an absorption surface 55, which could be a wall, window, or other part of an edifice, building, or the like. This surface 55 could be painted black to absorb incoming radiation. Alternatively, the surface 55 could be a conventional solar collector placed behind the screen 50 to enhance collection efficiencies.

As shown, each of the wires 60 has an acute back edge 62, a front reflective face 64, and a reflective under surface 66. The back edge 62 welds to the vertically arranged rods 54 using conventional techniques. As shown, adjacent wires 60 are attached at a separation from one another on the rods 54 so that a curved or bent channel 56 is defined between each adjacent wire 60. The front face 64 extends from a front edge 63 and faces upwards toward the horizon at an angle $\theta_1$ from vertical. The under surface 66 also extends from the front edge 63 but faces downward towards the surface 55 at an angle $\theta_2$ from horizontal. The reflective faces 64 and surfaces 66 can be polished or coated to enhance their reflectivity.

The angular orientation $\theta_1$ of the front face 64 can be selected to passively reflect solar energy incident thereto away from the surface 55 in the summer months (when the sun's elevation is high) and to passively reflect the solar energy upwards towards the adjacent wire 60 in the winter months (when the sun's elevation is low on the horizon). Likewise, the angular orientation $\theta_2$ of the under surface 66 can be selected to passively reflect the reflected solar energy incident thereto from the wire 60 below towards the surface 55 in the winter months. In this way, the screens 50 can help maintain the surface 55 cooler in the summer months and can provide heat energy to the surface 55 in the winter.

The reflective face 64 and surface 66 could be either flat or curved (parabolic) to maximize collection efficiency. In one implementation, the front face 64 can be flat as shown in FIGS. 4A-4B and can be at the acute angle $\theta_1$ of approximately 45-degrees from vertical. The under surface 66 can also be flat as shown and can be at the acute angle $\theta_2$ of about 15-degrees from horizontal. However, the angles, size, and separation of the wires 60 may change depending on the latitude of the building or other structure on which they are used and depending on the orientation of the screen 50 relative to the sun's rays. (The orientations of the sun's rays 32/42 depicted in the drawings are representative and provided for illustrative purposes.)

As shown in FIG. 4A, the wires' front faces 64 of the wires 60 reflect rays 32 from the sun at the higher summer elevation incident thereto away from the screen 50. In this way, the screen 50 functions as a reflector during summer months when the sun's elevation is high on the horizon so that the energy from the sun's rays 32 can be reflected away from the surface 55.

As shown in FIG. 4B, the wires' front faces 64 reflect rays 42 from the sun at the lower winter elevation incident thereto upward toward the angled under surfaces 66 of adjacent wires 60. In turn, the under surfaces 66 reflect the rays back towards the building's surface 55. In this way, the wire screen 50 functions as a collector of the sun's rays 42 during winter months when the sun's elevation is lower on the horizon so that the energy from the sun's rays 42 can be reflected onto the surface 55.

Figure 5A:
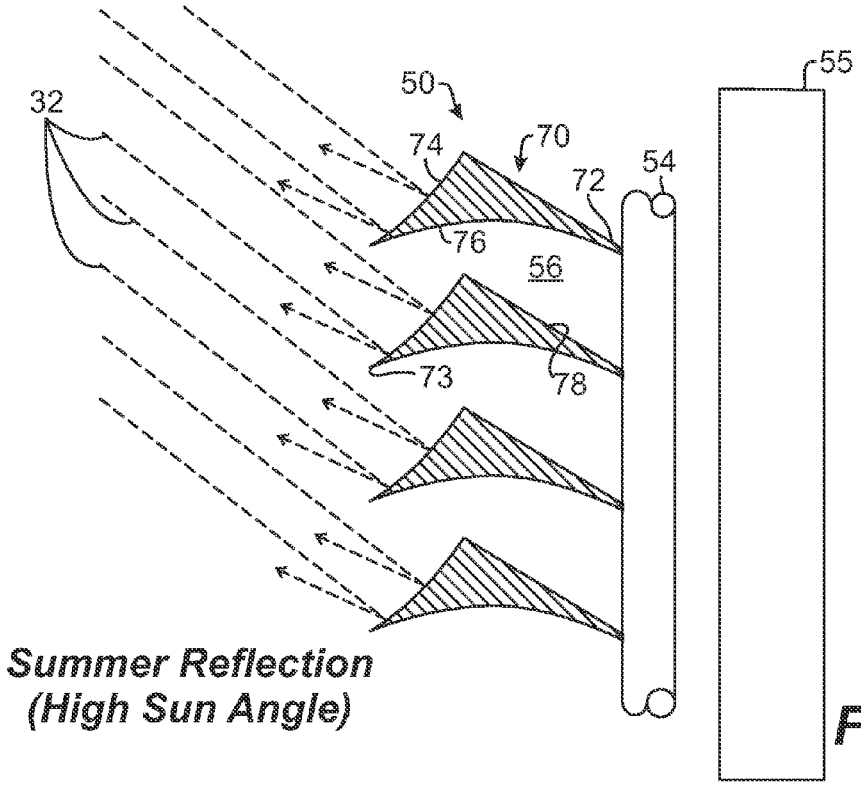
FIG. 5A shows an end view of portion of a wire screen having another type of wire during a summer reflection period.
Figure 5B:
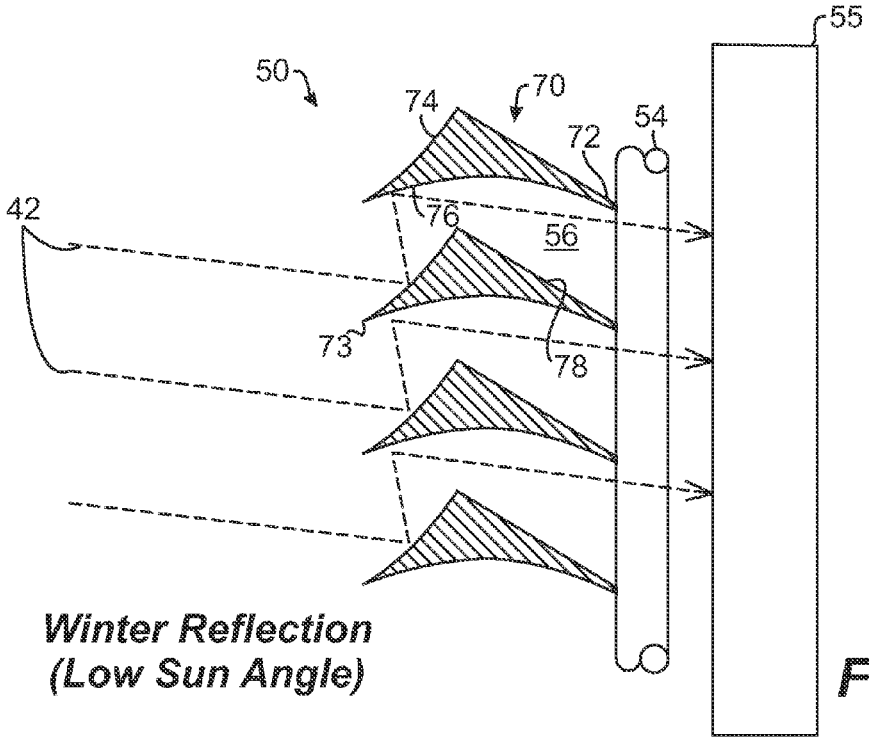
FIG. 5B shows an end view of the wire screen of FIG. 5A during a winter reflection period.

In FIGS. 5A-5B, details of another embodiment of wires 70 for the disclosed wire screen 50 are illustrated in end views. As before, these wires 70 have acute back edges 72 that weld to the rods 54 of the screen 50. In contrast to the previous embodiment, the wires 70 have concave front faces 74 and concave under surfaces 76 that extend from front edges 73. As before, adjacent wires 70 are attached at a separation from one another on the rods 54 so that the curved or bent channel 56 is defined between each adjacent wire 70.

As shown in FIG. 5A, the concave front faces 74 reflect rays 32 from the sun at the high summer elevation incident thereto away from the wires 70 so the wire screen 50 functions as a reflector and keeps the sun's energy away from the surface 55. As shown in FIG. 5B, the concave front faces 74 reflect rays 42 from the sun at the lower winter elevation incident thereto upward toward the concave under surface 76 of adjacent wires 70. In turn, the concave under surfaces 76 reflect the solar rays back towards the building's surface 55 so the wire screen 50 functions as a collector.

As noted previously, adjacent wires 60/70 are attached at a separation from one another on the rods 54 so that the curved or bent channel 56 defined between each adjacent wire 60/70 allows the reflected rays 42 to reach the surface 55. Each wire 60/70 has surfaces 68/78 above and below the back edge 62/72 that are oriented to create this channel 56. These surfaces 68/78 may also be capable of reflecting at least some of the thermal energy emanating from the surface 55 back to the surface 55.

Figure 6:
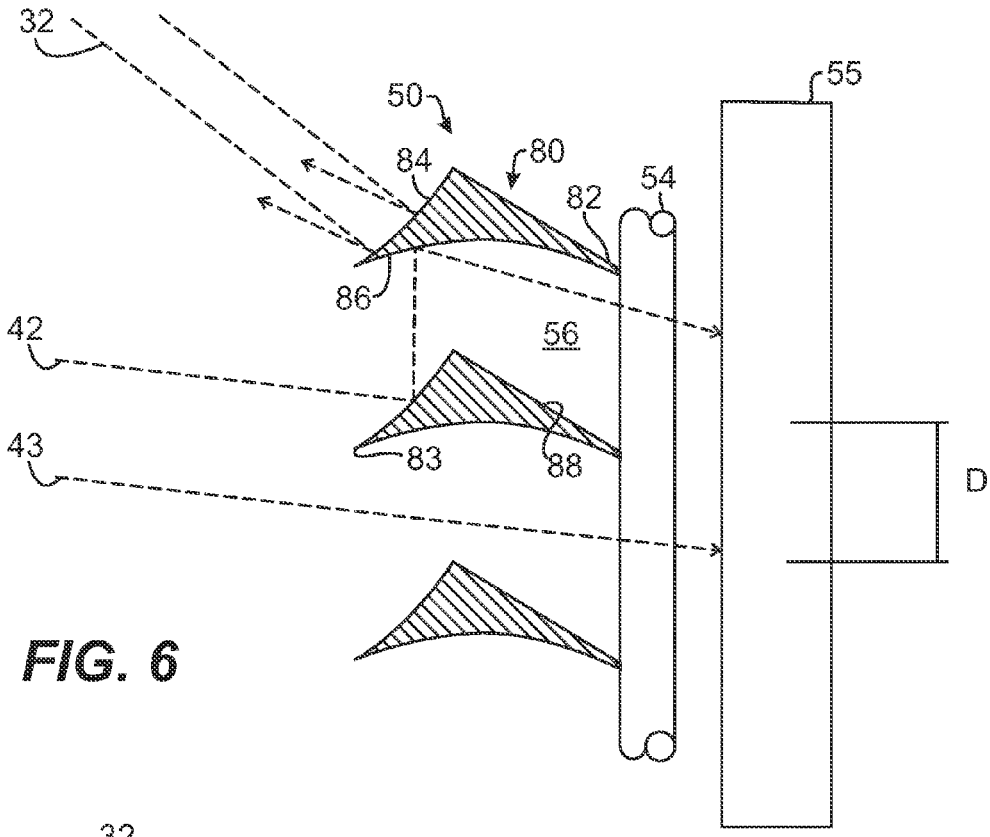
FIG. 6 shows an end view of a portion a wire screen having another arrangement of wires and FIG. 7 shows an end view of portion of a wire screen having yet another type of wire for reflecting thermal energy back to an adjacent edifice.

In FIG. 6, details of another arrangement of wires 80 for the disclosed wire screen 50 is illustrated in an end view. As before, these wires 80 have back edges 82 that weld to the rods 54 of the screen 50. In addition, the wires 80 have front faces 84 and under surfaces 86 that extend from front edges 83. These faces 84 and surface 86 can be curved as shown or can be angled as discussed previously. As before, the adjacent wires 80 are attached at a separation from one another on the rods 54 so that a channel 56 is defined between each adjacent wire 80.

When the sun is at the high summer elevation, the front faces 84 can reflect summer rays 32 incident thereto away from the wires 80 so the wire screen 50 functions as a reflector and keeps the sun's energy away from the surface 55. When the sun is at the lower winter elevation, the front faces 84 can reflect winter rays 42 incident thereto upward toward the under surface 86 of adjacent wires 80. In turn, the under surfaces 86 can reflect the solar rays back towards the building's surface 55 so the wire screen 50 functions as a collector. As further shown, the wires 80 can be separated by a predetermined distance D so that at least some winter rays 43 can pass between the adjacent wires 80 and reflect directly onto the building's surface 55 to provide heating benefits.

Depending on the separation D of the wires 80 and the elevation of the sun relative to the screen 50, such directly passed rays 43 may occur in addition to and/or as an alternative to reflecting the rays 42 from the faces 84, to the surfaces 86, and to the building's surface 55. At certain times in the winter, for example, the wires 80 can allow for direct passage of some winter rays 43 between the wires 80 without reflection on the face 84 and under surfaces 86 when these rays 43 have a particular angular orientation to the screen 50. At other times during the winter, however, the wires' faces 84 and surfaces 86 can be designed to either reflect or not reflect the rays 42 to the building surface 55 that are incident to the wires' front faces 84.

Figure 7:
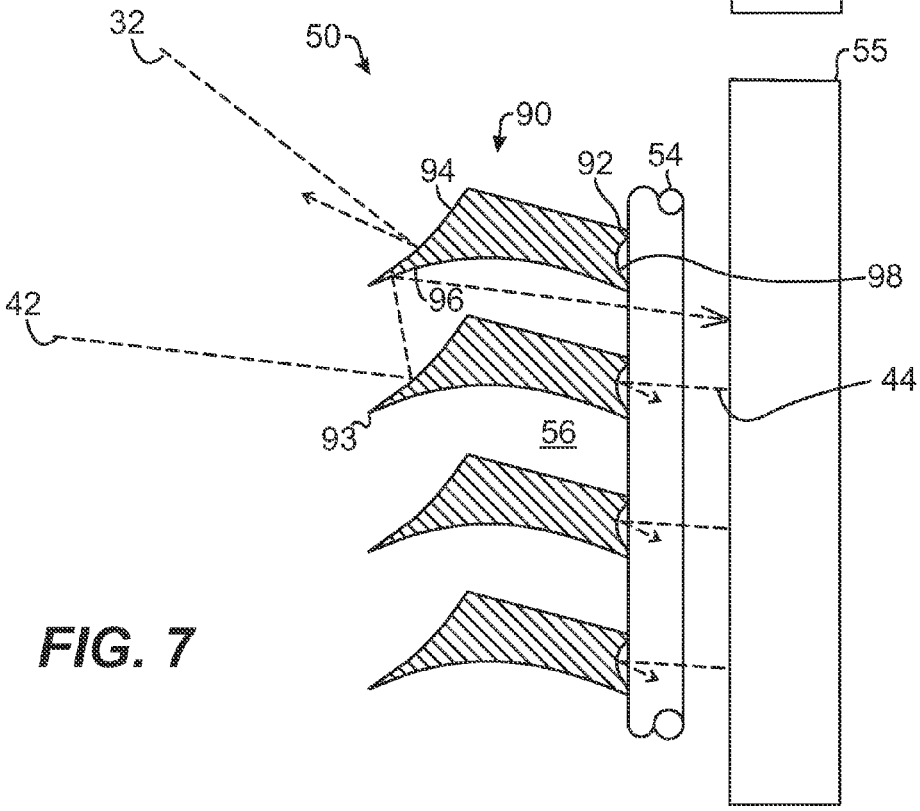

FIG. 7 shows an end view of portion of a wire screen having yet another embodiment of wire 90. Again, these wires 90 have rear edges 92 that weld to the rods 54 of the screen 50 and have front faces 94 and under surfaces 96. As before, adjacent wires 90 are attached at a separation from one another on the rod 54 with a curved or bent channel 56 defined between each adjacent wire 90. As opposed to other embodiments, these wires 90 also have concave or bent back surfaces 88 facing the surface 55 and intended to reflect thermal radiation 44 from the surface 55 back towards it. This reflection may reduce heat loss from the building's surface 55 during the night, for example.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A solar wire screen, comprising:

a plurality of rods arranged vertically; and a plurality of wires arranged horizontally, the wires having first edges attached to the rods and having second edges disposed away from the rods, each of the wires having:

a first surface extending from the second edge and facing upward at a first angle; and a second surface extending from the second edge and facing downward at a second angle different from the first angle, wherein the second surface forms at least a portion of one or more bottom surfaces extending between the second edge and the first edge, wherein the first surfaces reflect at least a portion of first solar energy, incident thereto at a first elevation, away from a front side of the wire screen, wherein the first and second surfaces reflect at least a portion of second solar energy, incident thereto at a second elevation, toward a back side of the wire screen, and wherein a line extending along and from the first surface of a first wire at the first angle intersects the one or more bottom surfaces of a second, adjacent wire.

2. The screen of claim 1, wherein the back side of the wire screen is adapted to be mounted adjacent an edifice.

3. The screen of claim 2, wherein a plurality of the wire screens are constructed as panels for mounting onto the edifice.

4. The screen of claim 1, further comprising a solar collector disposed adjacent the back side of the wire screen.

5. The screen of claim 1, wherein each of the wires comprise a third surface facing toward the back side of the wire screen, the third surfaces reflecting at least a portion of thermal radiation, incident thereto, away from the back side of the wire screen.

6. The screen of claim 5, wherein the third surface extends from the first surface and faces upward toward the back side of the wire screen.

7. The screen of claim 5, wherein the third surface is oriented vertically at the first edge.

8. The screen of claim 1, wherein the first surfaces face upward at a first acute angle from vertical toward the front side of the wire screen.

9. The screen of claim 8, wherein the second surfaces face downward at a second acute angle from vertical toward the back side of the wire screen, the second acute angle being greater than the first acute angle.

10. The screen of claim 1, wherein the first surfaces on the wires reflect at least a portion of the second solar energy, incident thereto at the second elevation, toward the second surfaces on adjacent ones of the wires.

11. The screen of claim 10, wherein the second surfaces on the wires reflect at least a portion of the second solar energy reflected from the first surfaces toward the back side of the wire screen.

12. The screen of claim 1, wherein at least one of the first and second surfaces is concave.

13. The screen of claim 1, wherein the first edges weld to the rods.

14. The screen of claim 1, wherein the wires define gaps therebetween directly passing at least a portion of the second solar energy toward the back side of the wire screen.

15. The screen of claim 1, wherein the first elevation corresponds to when the sun has a summer elevation on the horizon, and wherein the second elevation corresponds to when the sun has a winter elevation on the horizon.

16. A solar wire screen, comprising:

a plurality of rods arranged vertically; and a plurality of wires arranged horizontally, the wires having first edges attached to the rods and having second edges disposed away from the rods, each of the wires having:

a front surface extending from the second edge and facing upward;

a back surface facing toward the back side of the wire screen; and one or more bottom surfaces extending between the second edge and the first edge and facing downward, wherein the front surfaces reflect at least a portion of first solar energy, incident thereto at a first elevation, away from a front side of the wire screen, wherein the back surfaces reflect at least a portion of thermal radiation, incident thereto, away from a back side of the wire screen, and wherein the front surface and back surface of a first wire and the one or more bottom surfaces of a second, adjacent wire define a channel that is curved, substantially centrally bent, or curved and substantially centrally bent.

17. The screen of claim 16, wherein the back side of the wire screen is adapted to be mounted adjacent an edifice.

18. The screen of claim 17, wherein a plurality of the wire screens are constructed as panels for mounting onto the edifice.

19. The screen of claim 16, further comprising a solar collector disposed adjacent the back side of the wire screen.

20. The screen of claim 16, wherein the back surface extends from the first surface and faces upward toward the back side of the wire screen.

21. The screen of claim 16, wherein the back surface is oriented vertically at the first edge.

22. The screen of claim 16, wherein the first edges weld to the rods.

23. The screen of claim 16, wherein the front surface of the first wire and the one or more bottom surfaces of the second adjacent wire reflect at least a portion of second solar energy, incident thereto at a second elevation, toward a back side of the wire screen.

24. The screen of claim 23, wherein the front surfaces face upward at a first acute angle from vertical toward the front side of the wire screen, and wherein at least one of the one or more bottom surfaces face downward at a second acute angle from vertical toward the back side of the wire screen, the second acute angle being greater than the first acute angle.

25. The screen of claim 23, wherein the front surfaces on the wires reflect at least a portion of the second solar energy, incident thereto at the second elevation, toward the bottom surfaces on adjacent ones of the wires.

26. The screen of claim 25, wherein the bottom surfaces on the wires reflect at least a portion of the second solar energy reflected from the front surfaces toward the back side of the wire screen.

27. The screen of claim 23, wherein at least one of the front and bottom surfaces is concave.

28. The screen of claim 23, wherein the wires define gaps therebetween passing at least a portion of the second solar energy toward the back side of the wire screen.

29. The screen of claim 23, wherein the first elevation corresponds to when the sun has a summer elevation on the horizon, and wherein the second elevation corresponds to when the sun has a winter elevation on the horizon.

30. A solar wire screen, comprising:

a plurality of rods arranged vertically; and a plurality of wires arranged horizontally, the wires having first edges attached to the rods and having second edges disposed away from the rods, each of the wires having a front surface extending from the second edge and facing upward , each of the wires having a back surface facing toward the back side of the wire screen, wherein the front surfaces reflect at least a portion of first solar energy, incident thereto at a first elevation, away from a front side of the wire screen, wherein the back surfaces reflect at least a portion of thermal radiation, incident thereto, away from a back side of the wire screen, wherein the back surfaces are oriented vertically at the respective first edge, and wherein the back surfaces are concave.

* * * * *